United States Patent [19]

Jauncey

[11] Patent Number: 5,032,255

[45] Date of Patent: Jul. 16, 1991

[54] SEPARATION DEVICES FOR SEPARATING PARTICULATE MATERIAL

[76] Inventor: Alan R. Jauncey, 8 Boverton Court Estate, Boverton, Llantwit Major, South Glamorgan, CF6 9UJ, United Kingdom

[21] Appl. No.: 343,138

[22] Filed: Apr. 26, 1989

[30] Foreign Application Priority Data

Apr. 27, 1988 [GB] United Kingdom ..... 8810010
Oct. 26, 1988 [GB] United Kingdom ..... 8825049

[51] Int. Cl.[5] ..... B07C 15/00; B07C 13/04

[52] U.S. Cl. ..... 209/38; 209/11; 209/44.1; 209/621; 209/625; 209/628; 209/672

[58] Field of Search ..... 209/11, 628, 625, 672, 209/670, 38, 671, 668, 350, 361, 621, 629, 632, 441, 667

[56] References Cited

U.S. PATENT DOCUMENTS

| | | | |
|---|---|---|---|
| 2,984,357 | 5/1961 | Kufferath | 209/401 |
| 3,985,233 | 10/1976 | Sherman | 209/672 X |
| 4,452,694 | 6/1984 | Christensen et al. | 209/672 |
| 4,658,965 | 4/1987 | Smith | 209/672 |
| 4,778,061 | 10/1988 | Williams | 209/631 X |

FOREIGN PATENT DOCUMENTS

| | | | |
|---|---|---|---|
| 628826 | 11/1931 | Fed. Rep. of Germany | 209/672 |
| 20669 | of 1912 | United Kingdom | 209/667 |

*Primary Examiner*—Donald T. Hajec
*Attorney, Agent, or Firm*—Young & Thompson

[57] ABSTRACT

A particulate separating device (1) has an inlet (8) leading to sets of inter-leaved discs (2 and 3). The spacings between the discs determine the sizes of the particles which can pass through to an acceptance outlet (12) while larger particles are carried over to a rejection outlet (10). A comb-like barrier member (11) is interleaved with the set of discs (3) to assist in the removal of particles into the rejection outlet (10).

7 Claims, 3 Drawing Sheets

SEPARATION DEVICES FOR SEPARATING PARTICULATE MATERIAL

This invention is concerned with devices for separating particulate material acting in the manner of a sieve so that only particles of an acceptable size or characteristic will be passed to an acceptance outlet. Conventional sieves suffer from the disadvantage that they readily become clogged and so the equipment has to be stopped on a regular basis in order for the sieve to be cleaned or replaced. This invention aims to alleviate this particular problem.

Accordingly, the invention provides a separation device for particulate material comprising an enclosure incorporating at least two sets of rotatable discs which are interleaved with one another in a spaced relationship to extend across the width of the enclosure, one of the sets of discs also being interleaved across the width of the enclosure with a fixed comb-like barrier member leading to a rejection outlet for rejected particulate material not meeting predetermined parameters, an inlet to the enclosure positioned to one side of the sets of discs, the enclosure also having an acceptance outlet to the other side of the discs for acceptable particulate material which does meet the predetermined parameters and can pass through the spaces between the discs of the two sets.

Since the rejected material is carried over and ejected through a rejection outlet, clogging of the discs does not occur and the continuous rotational movement of the discs also is effective to reduce substantially the risk of clogging of the device.

In one arrangement the spaces between the discs determine the sizes of particles which may pass through to the acceptance outlet. Where there are at least three sets of discs it is advantageous to ensure that they are disposed at consecutively lower levels from the inlet down to the rejection outlet, so that the rejected particles are carried down from one set of discs to another until they are eventually pushed off by a comb-like barrier member. In a preferred modification of this arrangement, where there are several sets of discs, the spacings between the discs of adjacent sets increase consecutively from the inlet region to the rejection outlet region, and separate acceptance outlets are provided below each region having a particular disc spacing. An alternative arrangement has the discs divided into radial segments which can be selectively magnetised or demagnetised such that, as the discs rotate, only the top portions of the discs which are fed from the inlet will be in a magnetised state.

To assist in the carrying over of the rejected particles, it may be of advantage to provide that the circumferential edge of at least one of the sets of discs is serrated or of otherwise roughened configuration. If it is felt that the rejected particles might stick in the region of the comb, then a release member could be provided to direct material off the one set of discs as the material approaches the comb-like member. Such a release member could be a strip of material (either rigid or flexible) extending across the width of the enclosure. Another possibility is to provide the release member as a pipe extending across the width of the enclosure and incorporating holes for the emission of compressed air or steam.

Ideally the sets of discs will be carried on shafts connected to a common drive member. The device may incorporate a heater for heating the regions incorporating the discs.

The invention may be performed in various ways and preferred embodiments thereof will now be described with reference to the accompanying drawings, in which.

Figure 1:
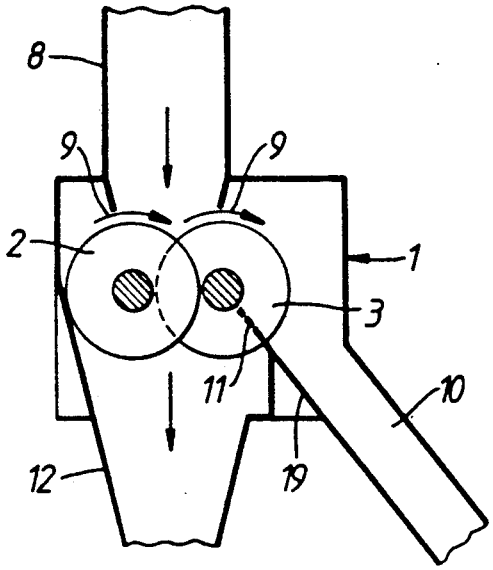
FIG. 1 is a diagrammatic section through a separation device constructed in accordance with this invention.
Figure 2:
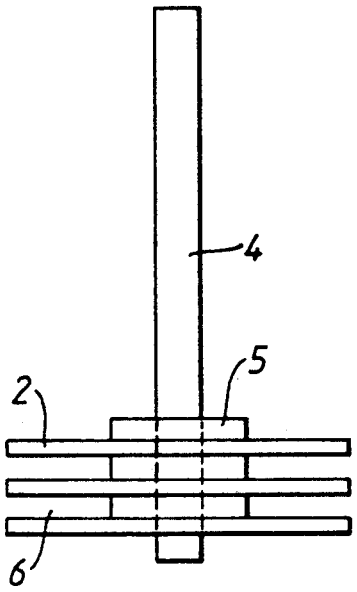
FIG. 2 is a view of parts of a set of discs used in the device of FIG. 1.
Figure 3:
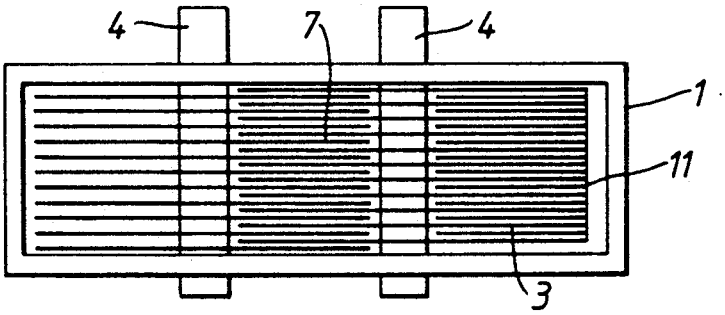
FIG. 3 is a plan view of the interior of the device shown in FIG. 1.

The device shown in FIG. 1 comprises an outer enclosure 1, within which are disposed two sets of rotatable discs 2, 3. As can be seen from FIG. 2, the discs are set on a drive shaft 4, with spacer members 5 to define gaps 6 which are larger in width than the discs 2 and 3 themselves. FIG. 3 shows how the sets of discs are interleaved at 7 to define clearances through which particles of a predetermined size can pass. Particulate material is introduced to the enclosure 1 through an inlet 8 and thus falls onto the two sets of discs 2 and 3 which rotate in the direction of the arrows 9. Particles of a sufficiently fine size will fall through the clearance spaces between the discs in the region 7 to an acceptance outlet 12, whilst large particles will be carried over by the discs 3 and will fall into a rejection outlet 10. A comb-like barrier member 11 is interleaved with the discs 3 so as to create a barrier which will prevent the large particles from passing through to the acceptance outlet 12.

Figure 4:
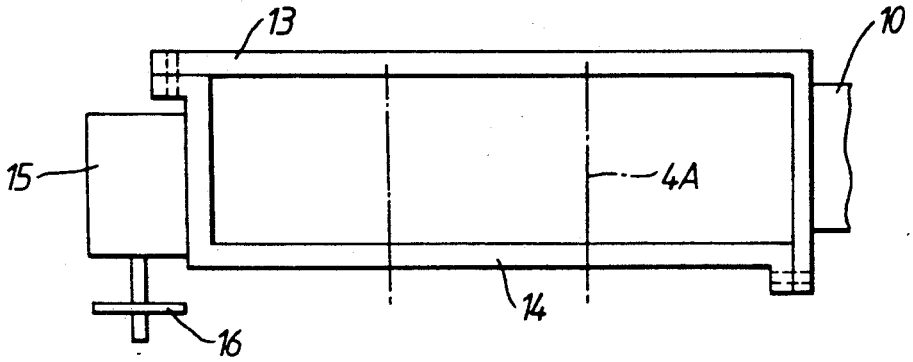
FIG. 4 illustrates features of construction of the outside enclosure of the device of FIG. 1.

The walls of the enclosure are ideally formed in two parts 13, 14 (FIG. 4) which can be detached from one another to provide access to the interior of the enclosure and to the discs 2 and 3 carried on their shafts 4 (as aligned on the axes 4A). This enables the sets of discs to be changed for ones defining larger or smaller clearance spaces in the region 7. A drive unit 15 drives a wheel 16 which will be interconnected with the shafts 4 by suitable gearing so that they are driven in the required manner.

Figure 5:
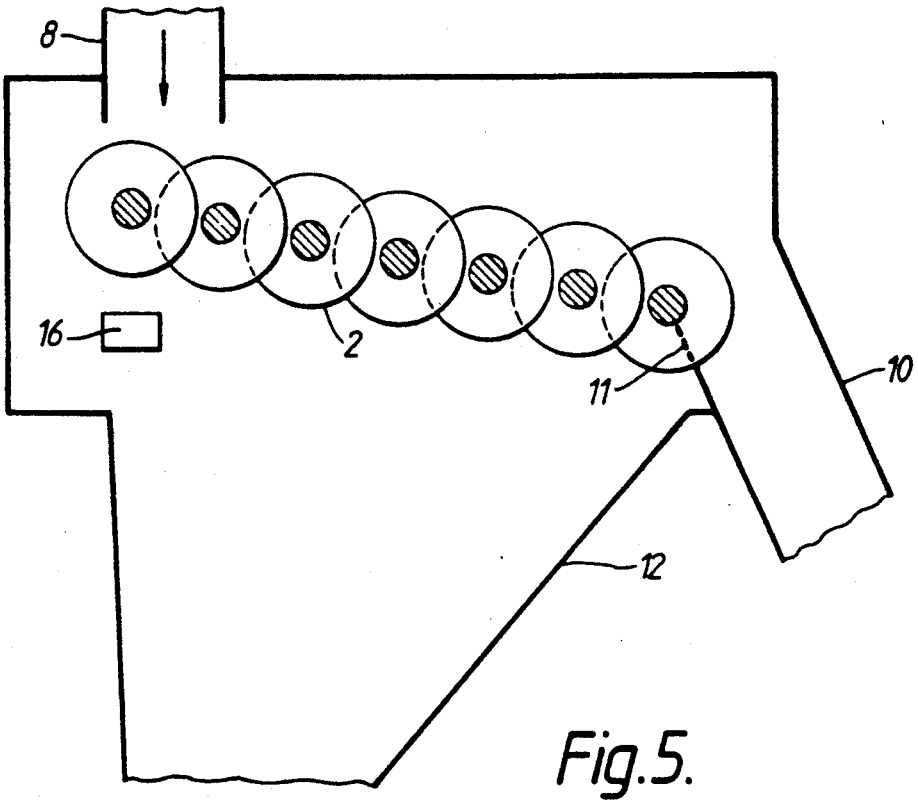
FIG. 5 illustrates a modified form of separation device incorporating several sets of discs.

In the alternative arrangement shown in FIG. 5 seven sets of interleaved discs 2 are provided. The drive shafts for these sets of discs are set on a downward incline so that oversize particles are carried over from one set of discs to the next until they reach the rejection outlet 10. This elongated arrangement provides greater opportunity for particles of the required size to pass through to the acceptance outlet 12 and for larger particles to be broken down to an acceptable small size, as they pass down the chain of discs 2.

Figure 6:
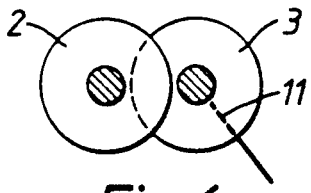
FIGS. 6 to 10 show various modifications to the design of a comb-like barrier member of the device and some associated parts.
Figure 7:
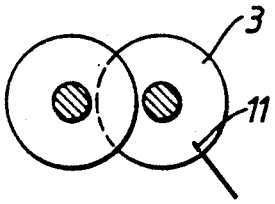

FIGS. 6 and 7 respectively show the possible maximum and minimum lengths for the barrier members 11.

FIG. 7 also shows serration of the circumference of the discs 2 and 3.

Figure 8:
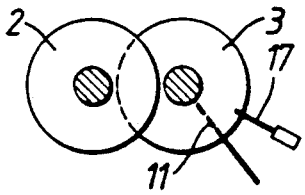

FIG. 8 shows how a strip of flexible material 17 may be provided to push away any material tending to stick to the set of discs 3 as they approach the barrier member 11.

Figure 9:
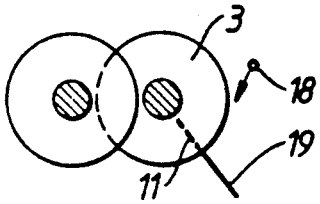

In FIG. 9 a pipe 18 is provided through which compressed air or steam may be blown to force particles off the surface of the discs 3 onto the extension part 19 of the barrier member 11.

Figure 10:
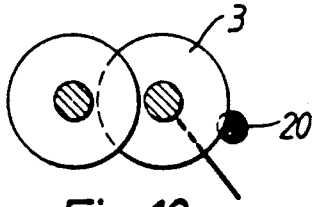

FIG. 10 shows the provision of a set of small but rough-edged discs 20 which also act to push off material sticking to the discs 3.

The separation device illustrated in the drawings operates as a self-cleaning sieve which can be operated continuously. The device will be relatively vibration-free and quiet and sealed from the outside environment. The separation device is therefore an ideal replacement for a vibrating mesh sieve.

Figure 11:
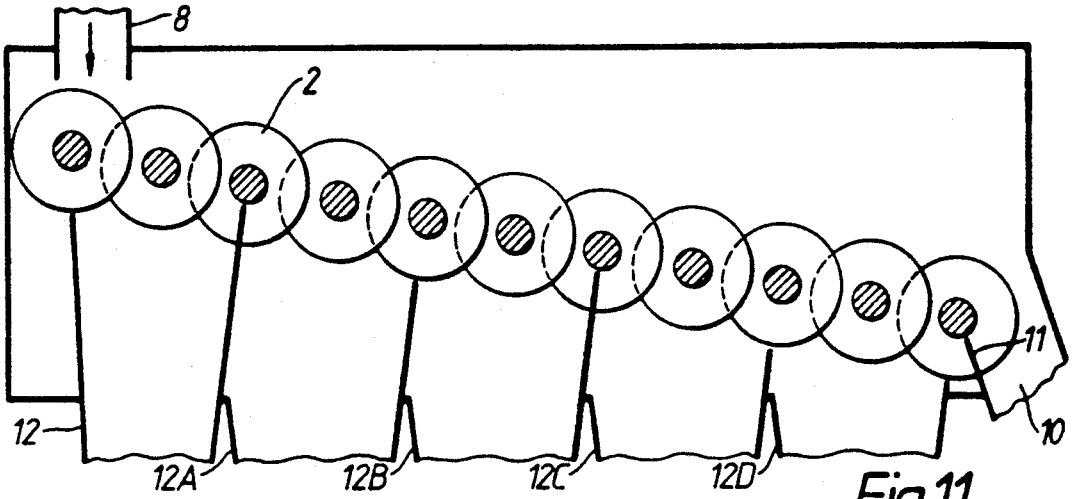
FIGS. 11 and 12 are side and plan views respectively of a multi-row separation device of this invention.
Figure 12:
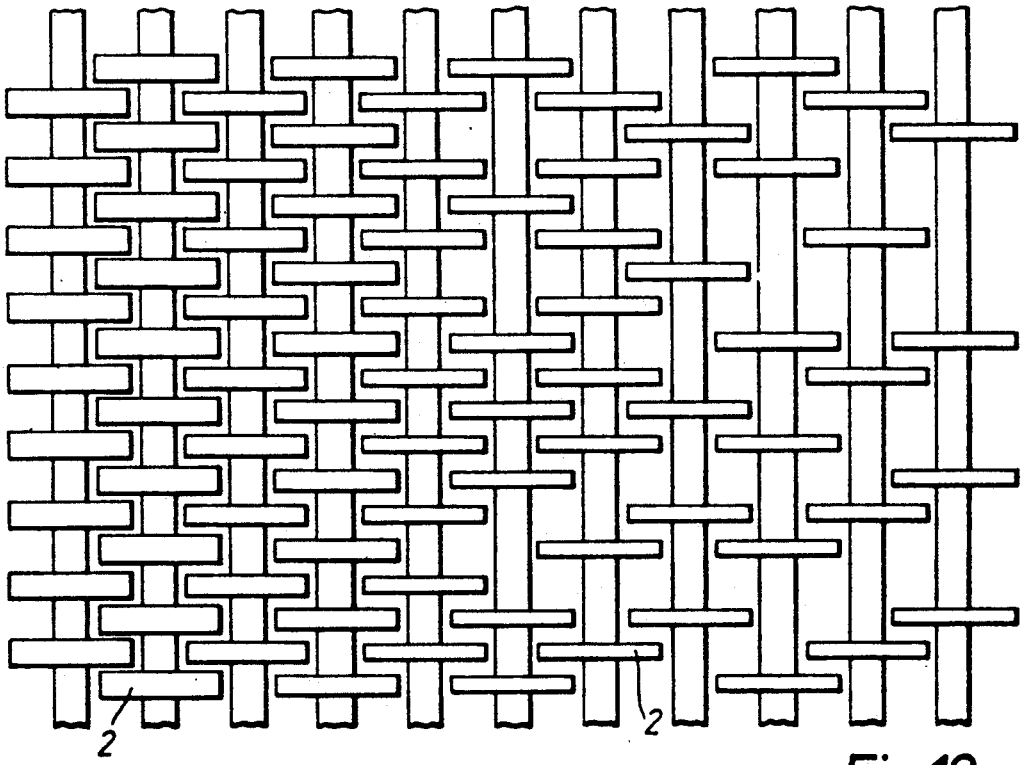

In the arrangement shown in FIGS. 11 and 12 a multi-row device is illustrated which will be suitable for grading particulate material to a number of different sized outputs. FIG. 11 is a side view similar to that of FIG. 5 but with the addition of extra output/acceptance outlets 12A to 12D. FIG. 12 is a plan view of the interior of the device shown in FIG. 11, illustrating the arrangement of decreasing numbers of discs leading towards the rejection outlet 10. Above output 12A the gaps between the discs are greater than above 12, and greater still above output 12B, and so on. Thus, graded particles of increasingly greater size will be received as the material progresses from the first outlet 12 to the reject outlet 10.

For cleaning adhesive material from the discs, after removing the feed of particulate material, the speed of the discs may be increased so that any material tending to stick to the discs would be thrown off by centrifugal force.

Figure 13:
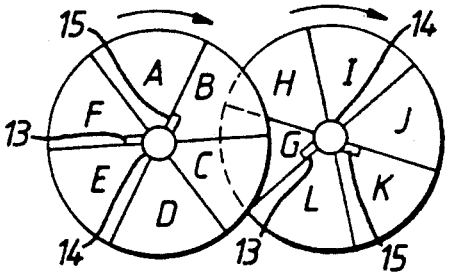
FIG. 13 is a side view of part of a magnetic separation device of this invention.

The arrangement shown in FIG. 13 incorporates electro-magnets which are built into the discs in sections. With the discs in the positions shown only sections F, A, G, H, I and J would be magnetised (via bushes 13 on segmented support spindles 14 for the disc). De-magnetization is achieved by bushes 15 on the spindles 14. As the discs are rotated in the directions shown the magnets entering sections B and K will be switched off, while the magnets leaning sections E and L will be switched on. Only the upper portions of the discs will therefore be magnetised and will carry over magnetic particles, whilst non-magnetic particles are allowed to fall down through the gaps between the discs. This enables magnetic particles to be separated from non-magnetic particles.

It may be advantageous to apply a non-stick coating to the internal parts such as the discs. Furthermore, the internal parts might be made out of high temperature-resisting ceramics. The device would then be capable of separating particulate material at high temperatures. Heater elements 16 (FIG. 5) could be installed into the device underneath the first sets of discs. On multiple discs versions in particular heater elements could be built into the discs.

I claim:

1. A separation device for particulate material comprising an enclosure, at least two sets of rotatable discs on respective shafts disposed within the enclosure and interleaved with one another in a spaced relationship to extend across the width of the enclosure so as to define two regions respectively above and below the interleaved discs, a fixed comb-like barrier member interleaved with one of the sets of discs across the width of the enclosure, a rejection outlet leading from the upper region beyond the barrier member for rejected particulate material not meeting predetermined parameters, an inlet to the upper region of the enclosure, and an acceptance outlet leading from the lower region of the enclosure for acceptable particulate material which does meet the predetermined parameters and can pass through the spaces between the discs of the two sets, and wherein there are at least three sets of discs which are disposed at consecutively lower levels from the inlet down to the rejection outlet, and the spacings between the discs of adjacent sets increase consecutively from the inlet to the rejection outlet, whilst the shafts are evenly spaced, and separate acceptance outlets are provided below each disc spacing.

2. A separation device according claim 1, wherein the circumferential edge of at least one of the sets of discs is of serrated or of otherwise roughened configuration.

3. A separation device according to claim 1, wherein the sets of discs are carried on shafts connected to a common drive member.

4. A separation device according to claim 1, wherein a release member is provided to direct material off the set of discs interleaved with the comb-like barrier as the material approaches the comb-like member.

5. A separation device according to claim 4, wherein the release member is a strip of material extending across the width of the enclosure.

6. A separation device according to claim 4, wherein the release member is a pipe extending across the width of the enclosure and incorporating holes for the emission of compressed gas.

7. A separation device for particulate material comprising an enclosure, at least two sets of rotatable discs on respective shafts disposed within the enclosure and interleaved with one another in a spaced relationship to extend across the width of the enclosure so as to define two regions respectively above and below the interleaved discs, a fixed comb-like barrier member interleaved with one of the sets of discs across the width of the enclosure, a rejection outlet leading from the upper region beyond the barrier member for rejected particulate material not meeting predetermined parameters, an inlet to the upper region of the enclosure, and an acceptance outlet leading from the lower region of the enclosure for acceptable particulate material which does meet the predetermined parameters and can pass through the spaces between the discs of the two sets, the discs being divided into radial segments, and means are provided for selectively magnetizing and demagnetizing the segments such that, as the discs rotate, only the top portions of the discs which are fed from the inlet will be in a magnetized state.

* * * * *